US011885601B1

(12) United States Patent
Hoppe et al.

(10) Patent No.: US 11,885,601 B1
(45) Date of Patent: Jan. 30, 2024

(54) VARIABLE ANGLE LOAD TRANSFER DEVICE

(71) Applicant: Government of the United States, as represented by the Secretary of the Air Force, Wright-Patterson AFB, OH (US)

(72) Inventors: Christopher Hoppe, Ridgefield, WA (US); Andrew Ehler, Urbandale, IA (US); Matthew Snyder, Colorado Springs, CO (US)

(73) Assignee: United States of America as represented by the Secretary of the Air Force, Wright-Patterson AFB, OH (US)

( * ) Notice: Subject to any disclaimer, the term of this patent is extended or adjusted under 35 U.S.C. 154(b) by 409 days.

(21) Appl. No.: 17/373,824

(22) Filed: Jul. 13, 2021

Related U.S. Application Data

(63) Continuation-in-part of application No. 17/373,101, filed on Jul. 12, 2021.

(60) Provisional application No. 63/158,541, filed on Mar. 9, 2021.

(51) Int. Cl.
*F42B 10/62* (2006.01)
*F42B 10/46* (2006.01)

(52) U.S. Cl.
CPC ..... *F42B 10/62* (2013.01); *F42B 10/46* (2013.01)

(58) Field of Classification Search
CPC ..... F42B 10/42; F42B 10/60; F42B 10/62
See application file for complete search history.

(56) References Cited

U.S. PATENT DOCUMENTS

| | | | | | |
|---|---|---|---|---|---|
| 882,980 | A * | 3/1908 | Tucker | F42B 10/46 | 114/20.1 |
| 3,262,655 | A * | 7/1966 | Gillespie, Jr. | F42B 10/62 | 244/3.21 |
| 3,433,439 | A * | 3/1969 | Brame | B64C 1/28 | 244/121 |
| 4,399,962 | A * | 8/1983 | Wedertz | F42B 10/62 | 244/3.23 |
| 4,579,298 | A * | 4/1986 | Thomson | F42B 19/005 | 244/3.21 |
| 4,681,283 | A * | 7/1987 | Kranz | F42B 10/663 | 244/3.22 |
| 4,925,130 | A * | 5/1990 | Kranz | F42B 10/62 | 244/3.21 |

(Continued)

*Primary Examiner* — Nicholas McFall
*Assistant Examiner* — Marisa V Conlon
(74) *Attorney, Agent, or Firm* — AFMCLO/JAZ; Matthew D. Fair

(57) ABSTRACT

A missile comprises a generally cylindrical body having a distal end and a proximal end; a nosecone having a pointed distal end and a proximal end, wherein the proximal ends of the body and nosecone are oriented toward each other; a forward angled section rotatably attached to the proximal end of the nosecone at its forward edge, the opposite end of the forward angled section having an angled edge perpendicular to the longitudinal axis except for the angle defined by the edge; a rear angled section rotatably attached to the proximal end of the body at its rear edge, the opposite end of the forward angled section having an angled edge matching the angled edge of the forward angled section, the angled edges of the forward angled section and the rear angled section being rotatably attached.

3 Claims, 14 Drawing Sheets

(56) References Cited

U.S. PATENT DOCUMENTS

| | | | | |
|---|---|---|---|---|
| 4,998,994 | A * | 3/1991 | Schmidt | F42B 10/02 244/3.1 |
| 5,139,216 | A * | 8/1992 | Larkin | F42B 10/26 244/3.21 |
| 5,564,651 | A * | 10/1996 | Wiemer | F42B 10/661 244/3.21 |
| 5,708,232 | A * | 1/1998 | Nedderman, Jr. | B63H 25/00 244/3.21 |
| 6,467,722 | B1 * | 10/2002 | Berry | F42B 10/62 244/3.21 |
| 6,646,242 | B2 * | 11/2003 | Berry | F42B 15/01 244/3.1 |
| 6,666,402 | B2 | 12/2003 | Rupert et al. | |
| 7,947,938 | B2 | 5/2011 | Dryer | |
| 8,021,253 | B2 | 9/2011 | Dell et al. | |
| 8,434,712 | B1 * | 5/2013 | Teter | F42B 10/62 244/3.21 |
| 8,466,397 | B1 | 6/2013 | Teter et al. | |
| 11,009,323 | B2 * | 5/2021 | Rastegar | F42B 10/18 |
| 11,085,744 | B1 * | 8/2021 | Han | F42B 10/60 |
| 2004/0138700 | A1 | 7/2004 | Cooper et al. | |
| 2021/0177529 | A1 | 6/2021 | Liu et al. | |

* cited by examiner

VARIABLE ANGLE LOAD TRANSFER DEVICE

Pursuant to 37 C.F.R. § 1.78(a)(4), this application claims the benefit of and priority to prior filed Provisional Application Ser. No. 63/051,928, filed 15 Jul. 2020, and co-pending application Ser. No. 17/373,101, filed 12 Jul. 2021, which are expressly incorporated herein by reference.

RIGHTS OF THE GOVERNMENT

The invention described herein may be manufactured and used by or for the Government of the United States for all governmental purposes without the payment of any royalty.

FIELD OF THE INVENTION

The present invention relates generally to missiles and, more particularly, to adjustable or morphing nosecones for missiles.

BACKGROUND OF THE INVENTION

The current fleet of air-to-air missiles are fixed-body missiles; there are no components on the missile that change the angle of the nosecone relative to the body. The idea of a morphing nosecone has been considered previously; however, there are currently no known morphing-nosecone missiles. Prior art devices may be separated into two types. The first are those which integrate a small propulsion system to provide a thrust in the direction transverse to the missile body. This transverse thrust acts as a course correction aid, putting the missile back on an intended trajectory. The propulsion system may be integrated into the body or arrived at by ducting airflow past the missile through a series of ports and expelling the air in a specified direction. The second type of devices lead to yaw corrections by extending a small surface into the airflow. This surface generates a drag force on one side of the missile resulting in a yaw correction. These devices, while effective, result in a loss of missile kinetic energy, which can be detrimental as the missile enters end game, the few seconds prior to hitting the target.

Current air-to-air missiles have a fixed nosecone; the nosecone maintains the same angle of attack as the body throughout missile flight. No known prior art arrangements include a device to change the angle of the nosecone relative to the body. The idea of changing the nosecone angle relative to the missile body while the missile is in flight is not new, but this mechanism is a new and distinct arrangement. This arrangement represents the first design of a mechanism to achieve nosecone angle deflection while the missile is in flight. This design represents a new technology direction for missiles.

SUMMARY OF THE INVENTION

The present invention overcomes the foregoing problems and other shortcomings, drawbacks, and challenges of fixed missile nosecones. While the invention will be described in connection with certain embodiments, it will be understood that the invention is not limited to these embodiments. To the contrary, this invention includes all alternatives, modifications, and equivalents as may be included within the spirit and scope of the present invention.

The purpose of the high-speed, variable angle load transfer (HSVALT) device is to change the angle of missile, e.g. air-to-air missile, nosecones relative to the body of the missile in order to improve performance of the missile and improve kill probability. The mechanism rotates two slanted body sections relative to each other resulting in a nosecone angle change relative to the long axis of the missile body. At high speeds, the mechanical forces that must be generated to cause this angle change are very large due to the aerodynamic forces from Mach 2+ flight.

According to one embodiment of the present invention a missile comprises a generally cylindrical body having a distal end and a proximal end, and a longitudinal axis along its length; a nosecone having a pointed distal end and a proximal end, wherein the proximal ends of the body and nosecone are oriented toward each other; a forward angled section rotatably attached to the proximal end of the nosecone at its forward edge, the opposite end of the forward angled section having an angled edge perpendicular to the longitudinal axis except for the angle defined by the edge; a rear angled section rotatably attached to the proximal end of the body at its rear edge, the opposite end of the forward angled section having an angled edge matching the angled edge of the forward angled section, the angled edges of the forward angled section and the rear angled section being rotatably attached; wherein longitudinal rotation of the first angled section with respect to the second angled section yields angular displacement of the nosecone with respect to the body.

According to a first variation, the missile further includes a driveshaft oriented along the longitudinal axis of the body, the rear angled section, the forward angled section, and the nosecone, the driveshaft being releasably fixed to the rear angled section and forward angled section by respective clutches, the driveshaft having a flexible joint where the forward angled section and rear angled section interface; a motor rotatably fixed to the body and the driveshaft.

According to another variation, a flexible skin is arranged around the forward angled section and rear angled section, and the flexible skin is fixed to the proximal end of the nosecone and the proximal end of the body.

The features of the disclosed variations, as well as the additional features disclosed herein, may be combined in any fashion in order to achieve desired performance characteristics.

In the HSVALT, the motion is accomplished by torque transfer through strain-wave gears and a set of planetary gears to allow motion in opposite directions. This is a fundamental distinction from the prior art designs. The HSVALT relies on a motor which transmits torque to each slanted body section to drive the rotation. The motor may be centered in the body of the vehicle, i.e. missile, just downstream of the angled sections, or any other convenient location.

The HSVALT allows for wired connections between the nosecone and the body of the vehicle, contrary to the known prior art. Wired connections provide a more robust mechanism.

The HSVALT is inspired by the idea that a greater deflection angle will assist with maneuverability of the vehicle to allow for smaller-radius turns as required to keep the vehicle on its desired track. Trim stability may require small adjustments to the deflection angle, but additional maneuverability requires fast, radical adjustments to the deflection angle. The motor, strain wave gears and planetary gear set allow for this rapid transition of section spin or rotation relative to the other to achieve the desired maneuver.

Additional objects, advantages, and novel features of the invention will be set forth in part in the description which follows, and in part will become apparent to those skilled in the art upon examination of the following or may be learned by practice of the invention. The objects and advantages of the invention may be realized and attained by means of the instrumentalities and combinations particularly pointed out in the appended claims.

BRIEF DESCRIPTION OF THE DRAWINGS

The accompanying drawings, which are incorporated in and constitute a part of this specification, illustrate embodiments of the present invention and, together with a general description of the invention given above, and the detailed description of the embodiments given below, serve to explain the principles of the present invention.

Figure 1:
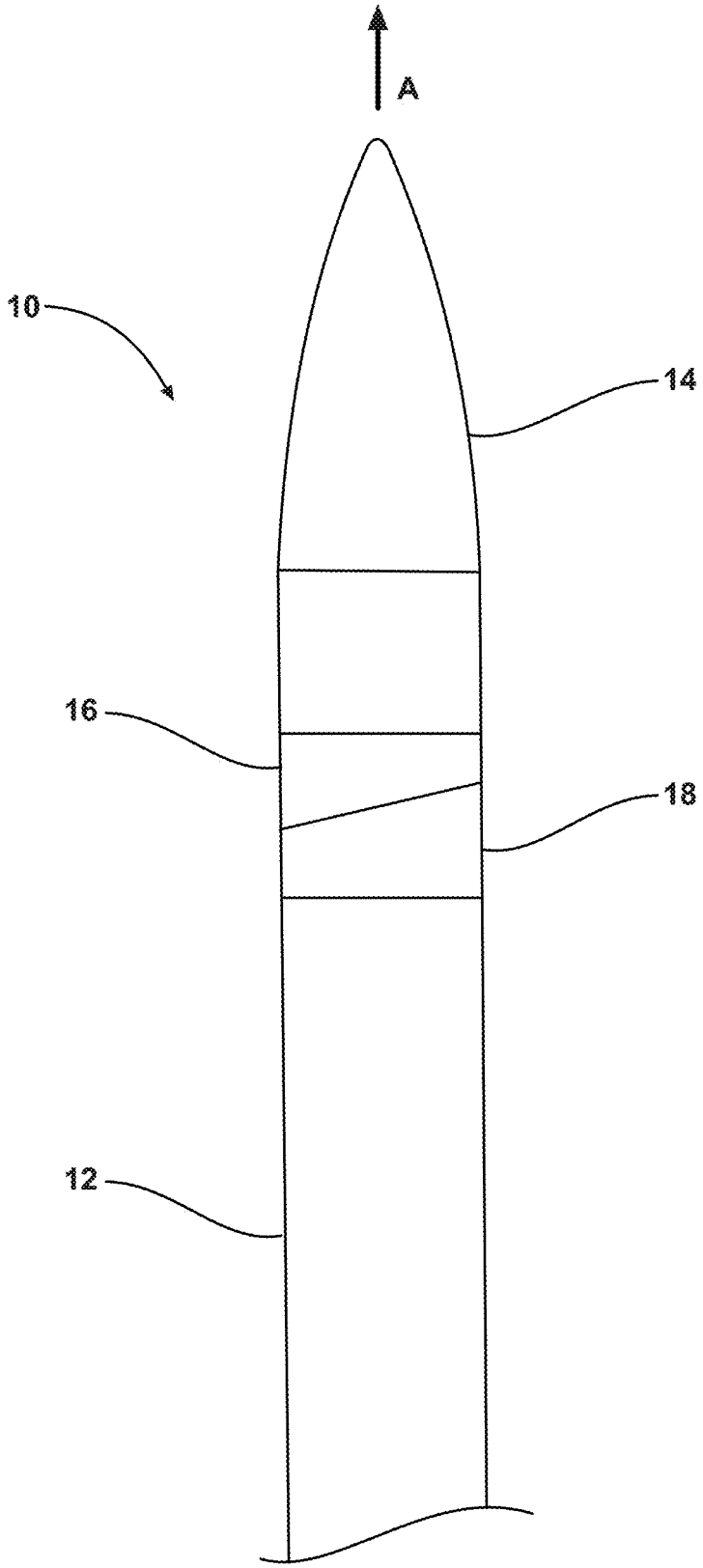
FIG. 1 depicts a High Speed Variable Angle Load Transfer (HSVALT) device incorporated into a missile.

It should be understood that the appended drawings are not necessarily to scale, presenting a somewhat simplified representation of various features illustrative of the basic principles of the invention. The specific design features of the sequence of operations as disclosed herein, including, for example, specific dimensions, orientations, locations, and shapes of various illustrated components, will be determined in part by the particular intended application and use environment. Certain features of the illustrated embodiments have been enlarged or distorted relative to others to facilitate visualization and clear understanding. In particular, thin features may be thickened, for example, for clarity or illustration.

DETAILED DESCRIPTION OF THE INVENTION

Air-to-air missiles typically include a nosecone-mounted seeker that tracks the intended target throughout the flight of the missile. The HSVALT device allows the nosecone to 'bend' in any direction around the longitudinal axis of the missile in order to improve the field-of-view of the seeker. In addition, changing the angle of the nosecone results in improved maneuverability thanks to the additional aerodynamic moment created by the bend. There are also further benefits during launch and flight of the missile.

This high-speed, variable angle load transfer device is designed specifically to change the angle of an air-to-air missile nosecone relative to the body of the missile. A novel, mechanical device is designed to achieve the desired angle change in order to provide dramatic improvements to current performance. The HSVALT includes components that provide torque transfer under load. In flight, the nosecone angle change results in significant loads that must be overcome by the HSVALT mechanism.

The invention provides a significant performance increase in air-to-air missiles. These performance improvements include increased range, enhanced tracking, particularly during end-game, and improved maneuverability during final engagement. Air-to-air missiles do not currently have this capability. The design is scalable; all current air-to-air missile designs may be modified to include this mechanism, leading to a performance increase for all missile classes.

The purpose of the high-speed, variable angle load transfer (HSVALT) device is to change the angle of air-to-air missile nosecones relative to the body of the missile in order to improve performance of the missile and improve kill probability. This mechanism enables torque transfer between two bodies, i.e. fore and aft sections of the missile body, under significant loading and at high speeds. The two angled body sections enable load transfer between the two joined bodies. A motor spins a central driveshaft which is connected to the angled body sections by a series of friction clutches, planetary gears, and an internal load-reducing strain wave gear. The motor spins at high revolutions per minute, e.g. 1000-5000 rpm, and the direction each angled section spins is determined by which clutch is currently engaged with the drive shaft. Depending on direction of spin, the angled section will be driven directly by the drive shaft or by a planetary gear system. The angle of the two connected bodies relative to each other is determined by both the angled body sections and the degree of rotation commanded to the motor. The commands and control of the system are communicated from the missile's computer, which performs navigation, fin control, and other calculations already present in a missile.

There are strict space and weight limitations to be kept in mind, depending on the missile's application. The HSVALT has two articulating sections, which reduces the complexity of the design such that control of the angle change is much easier to achieve. In addition, keeping the number of articulating sections to a minimum, i.e. two, increases the amount of internal volume available to contain the mechanism, which also allows a lower weight for the design.

"Dog-clutches" were found to be too bulky to fit within the space limitations of the missiles. Instead, electro-mechanical friction clutches are used to transfer the torque and rotate the HSVALT components. A series of planetary gears are included to ensure that the rotating sections may be powered in either direction of rotation by actuation of the clutch.

The inclusion of two strain-wave gears reduces the speed at which the sections spin relative to the motor, while increasing the amount of torque that may be transmitted. The strain-wave gears allow a much smaller motor to be used, which reduces weight and power consumption. Finally, in connection with the planetary gear set, the strain wave gears allowed each section to be actuated and rotated independently of the direction the motor was spinning. In one embodiment, the motor produces at least 10 foot-pounds, e.g. 11.94 ft-lb. The motor produces the required torque as it spins at about 3000 rpm. The 1:100 gear ratio of the strain wave gear in combination with the torque and rpm values allows for rotation of the angled section at about 30 rpm because of the 1:100 gear ratio of strain wave gear. This would allow for the nosecone to go from the maximum deflection angle of 30 degrees to 0 degrees in about one second. The exemplary motor is operable between 0-30 VDC, and 0-170 Amps.

A hollow drive shaft allows for the routing of control and powers wires internally from one end of the mechanism to the other. Power is maintained between the various sections of the missile by a series of slip rings, which allow for continuous electrical connections while allowing for the rotation of the angled body sections. The nosecone and missile body will not rotate with respect to each other. Only the angled body sections rotate, with respect to each other and with respect to the nosecone and missile body. The nosecone and missile body may be attached to opposite ends of a driveshaft that extends through the missile's longitudinal axis so as to maintain the nosecone and missile body in a fixed orientation to each other around their longitudinal axes, even when the nosecone is deflected or angled.

The HSVALT device includes numerous advantages, including a mechanical angled rotor design that changes the angle of the missile nosecone relative to the body axis. The mechanical design is robust and reliable. The HSVALT exhibits improved target tracking during flight and at end game, as well as improved flight efficiency. This permits longer flight times for the missile.

The HSVALT exhibits improved separation from internal weapons bays. Improved separation from internal weapons bays is accomplished via actuating the nosecone such that the nosecone is pointing away from the fuselage of the aircraft. When the missile drops out of the weapons bay, the nosecone is the first part of the missile to contact the shockwave from the front of the aircraft. With a sudden increase of lift on the forward nose, a typical missile will pitch back up, and may clip the tail of the aircraft at certain speeds. With the HSVALT, the aerodynamic forces experienced during missile separation may be mitigated, reducing the upward pitching moment to allow for improved separation at higher airspeeds.

As described and presented in the Figures, the HSVALT device includes a central drive shaft to drive the angle change. electro-mechanical clutches to reverse the direction of the body section spin relative to the direction of shaft spin, and a planetary gear set to allow spin in either direction.

The invention as it would appear in a missile 10 is presented in FIG. 1. The angled/slanted sections 16, 18 rotate relative to each other to drive the missile nosecone 14 to a prescribed deflection angle. A major focus of the invention is the mechanism (HSVALT device) that drives a nosecone angle change relative to the body 12. This involves insertion of two angled rotating sections 16, 18, seen in FIG. 1, which connect to the missile body 12 through crossed roller bearings 15 allowing angular motion with little to no friction, even when bending loads are applied as the nosecone 14 deflects. A crossed roller bearing is a type of bearing that uses alternating cylinder rollers instead of the spheres of a typical ball bearing. Also, the upper crossed roller bearing 15 (visible in FIG. 2) allows the nosecone 14 to remain at zero roll angle, relative to the missile body 12, throughout operation. The purpose for including the crossed roller bearing is to allow the device to control the direction of the nosecone 14, without rotating the nosecone about the longitudinal axis. In some embodiments, sensors present in the nosecone 14 may not effectively operate when experiencing roll. Therefore, to allow such systems to operate effectively, the orientation of the nosecone 14, i.e. rotational position of nosecone around the longitudinal axis A, must not change; the angular direction that the nosecone is pointing may be changed, but "up" must remain "up" with respect to the nosecone. The upper bearing (see FIG. 2) allows for the free rotation of the angled body sections about the lateral and vertical axes while eliminating any potential rotation about the longitudinal axis. In addition, where nosecone rotation is not permitted, a flexible skin 13 (see FIG. 14) may be used to couple the nosecone 14 to the missile body 12; the flexible skin 13 extends over the angled sections 16, 18, and prevents relative rotation of the nosecone 14 and body 12 around axis A.

The flexible skin 13 allows the missile seeker (located at extreme forward end of nosecone 14) to remain at the same angle/orientation throughout missile flight, which is important for missile guidance and control. The flexible skin 13 prevents the nosecone 14 and missile body 12 from rotating with respect to each other. Only the angled body sections (rotors) 16, 18 rotate in order to impart a relative angle between the nosecone and the missile body. The flexible skin 13 may be made of a wavespring-like skeleton 64 (or another configuration) made from a suitable spring metal or polymer infilled with a thioether elastomer 66. The thioether elastomer is similar to a foam, with hollow bubbles mixed in to form a composite structure. The design of the flexible spring minimizes longitudinal stiffness while maximizing radial and torsional stiffness. The skin may be attached to the nosecone and missile body with traditional screws, a band clamp, or by another type of fastener. The nosecone 14 and missile body 12 may be attached to opposite ends of a driveshaft 46 (see FIG. 8) that extends through and along the missile's 10 longitudinal axis so as to maintain the nosecone 14 and missile body 12 in a fixed orientation to each other around their longitudinal axes, even when the nosecone 14 is deflected or angled. The flexible skin 13 provides the torsional resistance to keep the nosecone in the same rotational orientation (around axis A) as the body. In another embodiment, relative rotation of the nosecone and the missile body is acceptable. In such cases the flexible skin is not required to connect the nosecone and the missile body.

Figure 2:
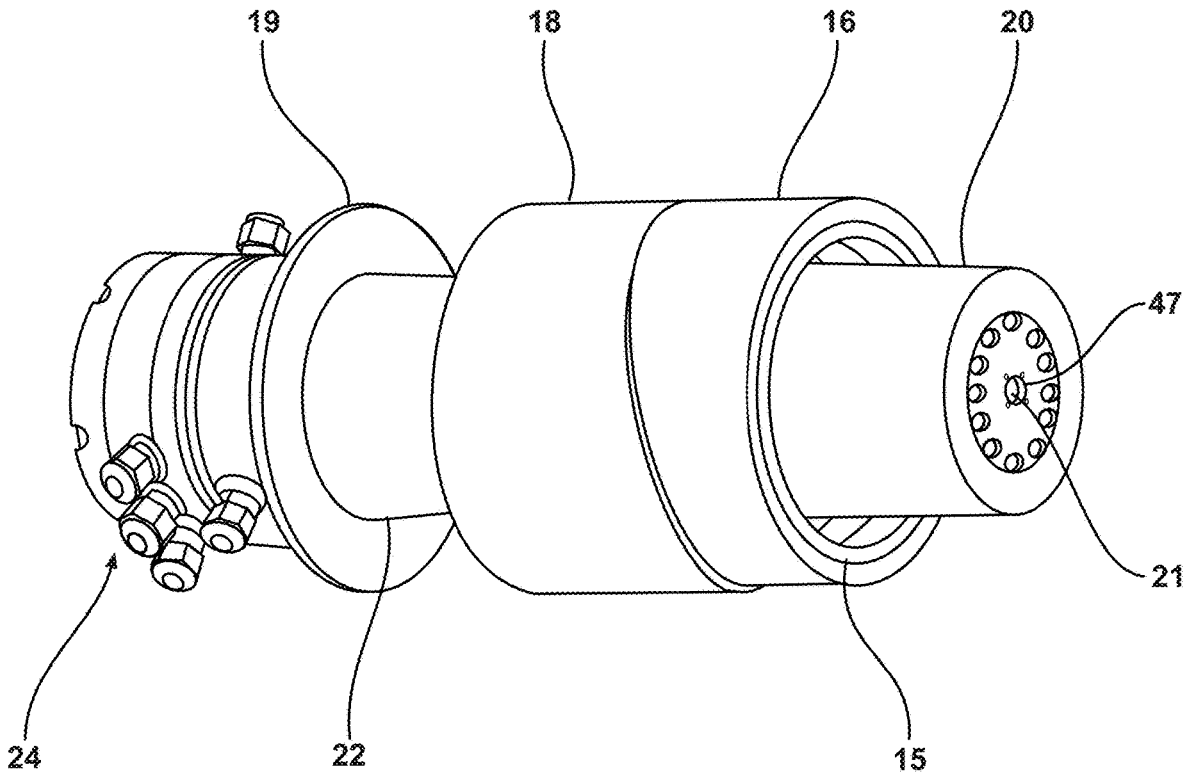
FIG. 2 depicts an HSVALT device with clutch mechanisms extending longitudinally forward and aft.

FIG. 2 shows more detail of the HSVALT design when the missile body 12 and nosecone 14 are removed. The motor 24 and clutch mechanisms 20, 22 extend into the body 12 and nosecone 14 of the missile 10. A single motor 24, rigidly connected to the missile body 12, transmits torque to two angled rotors 16, 18 through a coupled, central drive shaft 46. Each angled rotor, i.e. rotating section, 16, 18 houses a clutch mechanism 20, 22, allowing each section 16, 18 to rotate in either direction, independent of the other section and the motor direction as determined by a control algorithm, in response to a given a desired missile nosecone 14 deflection angle. The control of the nosecone 14 is accomplished by the guidance and control systems currently present on a missile 10, suitably modified to address the rotation of the angled body sections 16, 18. Therefore, no additional control hardware is used in the HSVALT design.

Each rotating section 16, 18 may have an angled edge, as seen in FIGS. 1-3. If the angle is 15 degrees, the nosecone 14 may be deflected up to 30 degrees from the longitudinal axis of the missile body 12. As desired, this angle may be modified so as to meet the required performance characteristics in the intended application of the device.

Figure 3A:
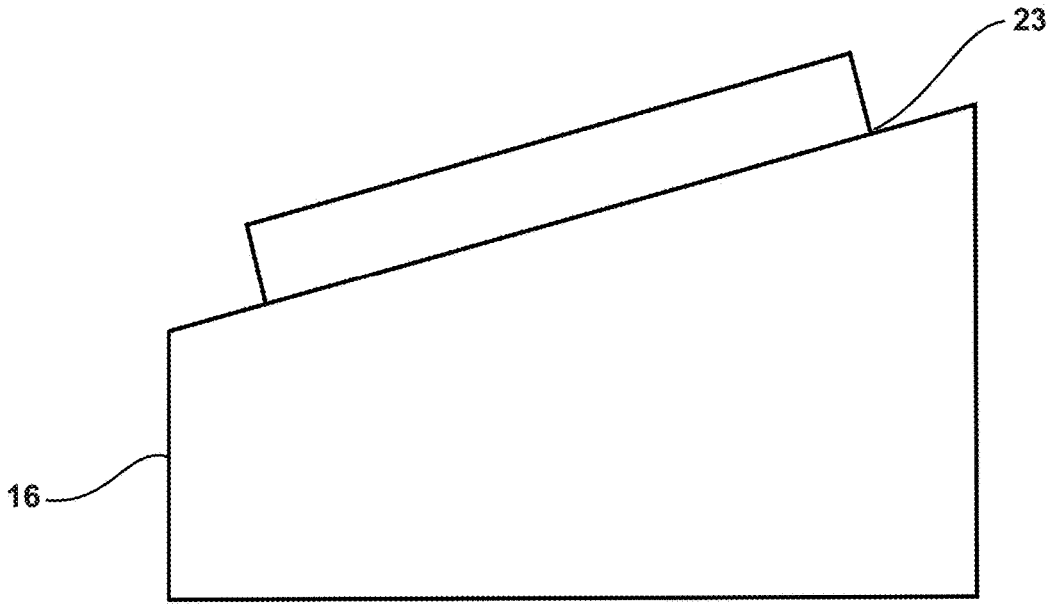
FIGS. 3A-3B present images of the upper or forward rotating section of the HSVALT device of FIGS. 1 and 2A-2B.
Figure 3B:
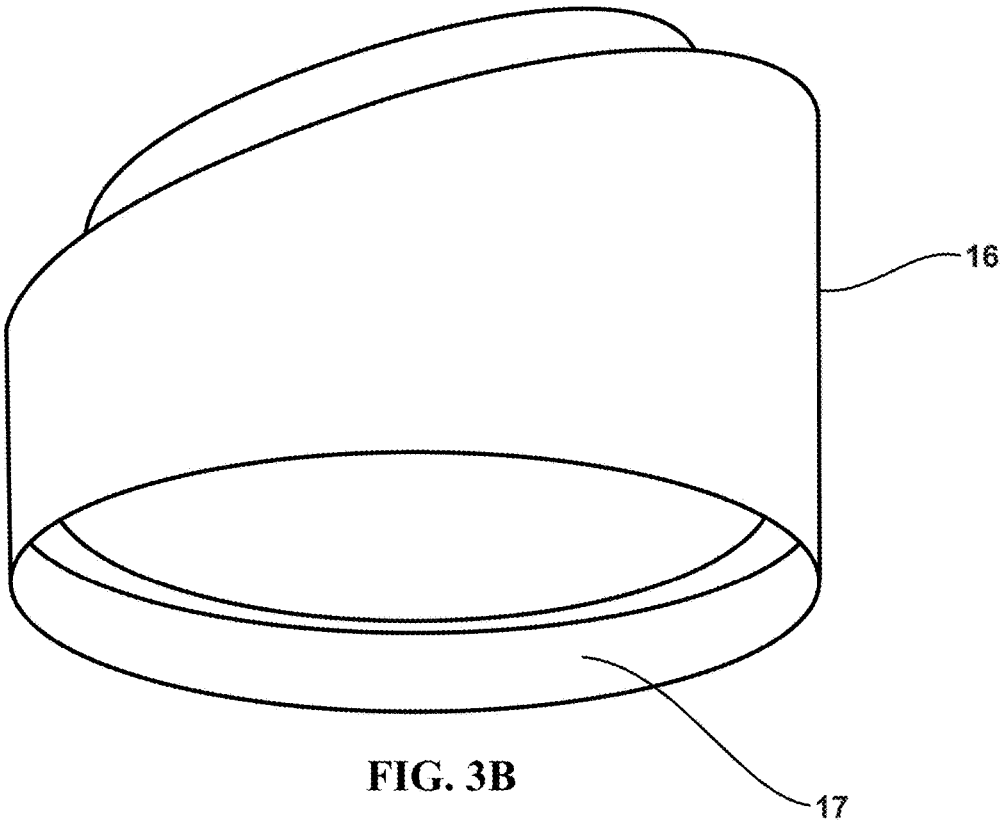

An upper or forward rotating section 16 is shown in FIGS. 3A-3B. The rotating sections 16, 18 interface via a crossed roller bearing at the angled faces 23, allowing the rotation of one angled section 16 relative to the other angled section 18. The angled sections 16, 18 are slightly different in that one section, e.g. the upper or forward section, may be press-fit to the inside of a crossed roller bearing 15 that is at a 15 degree angle, while the other section, e.g. rear section, may be press-fit on the outside of that bearing. FIGS. 3A-3B illustrate the section that is press fit on the inside. Both top 16 and bottom 18 angled sections have slots or flanges 17 (see FIG. 3B) for the upper and lower bearings to be press fit on the top and bottom of the respective sections. The three roller bearings 15 allow rotation of the angled sections 16, 18, with regard to the nosecone 14 and body 12, in the presence of axial twist (torque), and bending resistance, and are scaled to accommodate the significant loads that will be encountered.

Figure 4:
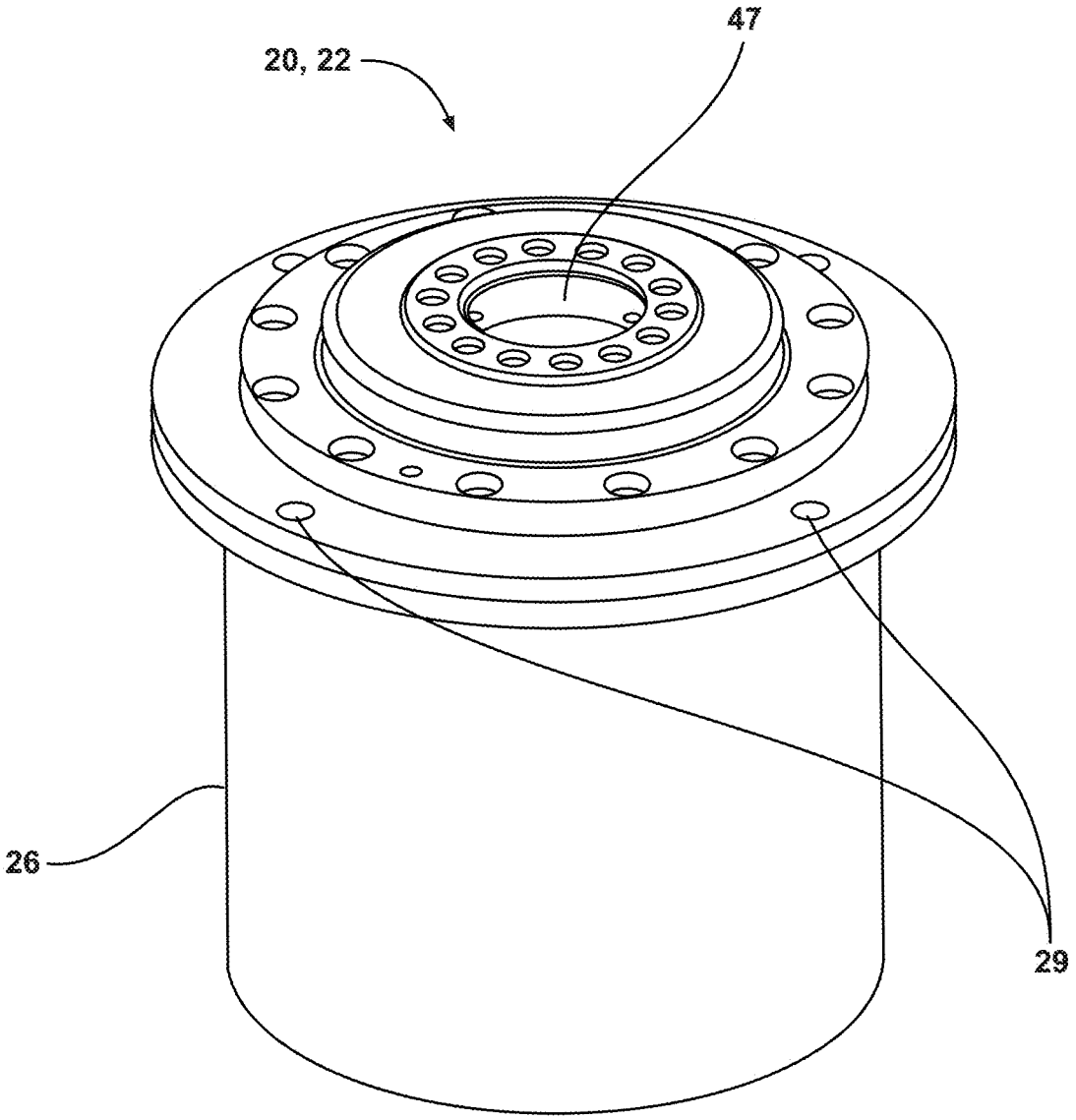
FIG. 4 depicts a clutch mechanism of an HSVALT device.

Each of the rotating sections 16, 18 is connected to an identical clutch mechanism 20, 22, an example of which is shown in FIG. 4. The outer housing 26 of the clutch mechanisms 20, 22 slides inside each rotating section (top and bottom) and interfaces with its rotating section via a strain wave gear assembly 44. There are two of these clutch housings 26, one per section 16, 18.

Figure 5:
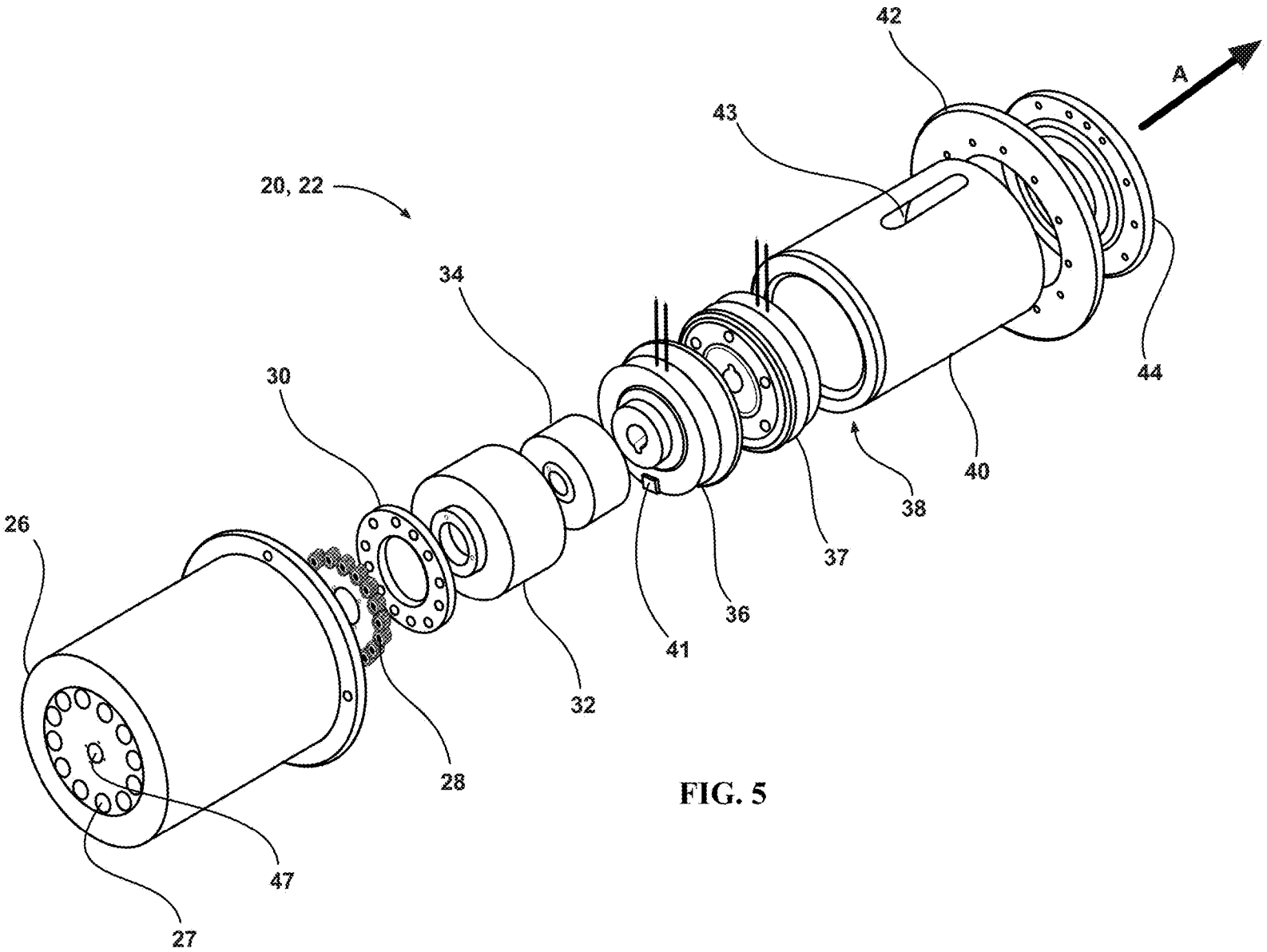
FIG. 5 presents an exploded view of clutch mechanism for an HSVALT device.
Figure 6:
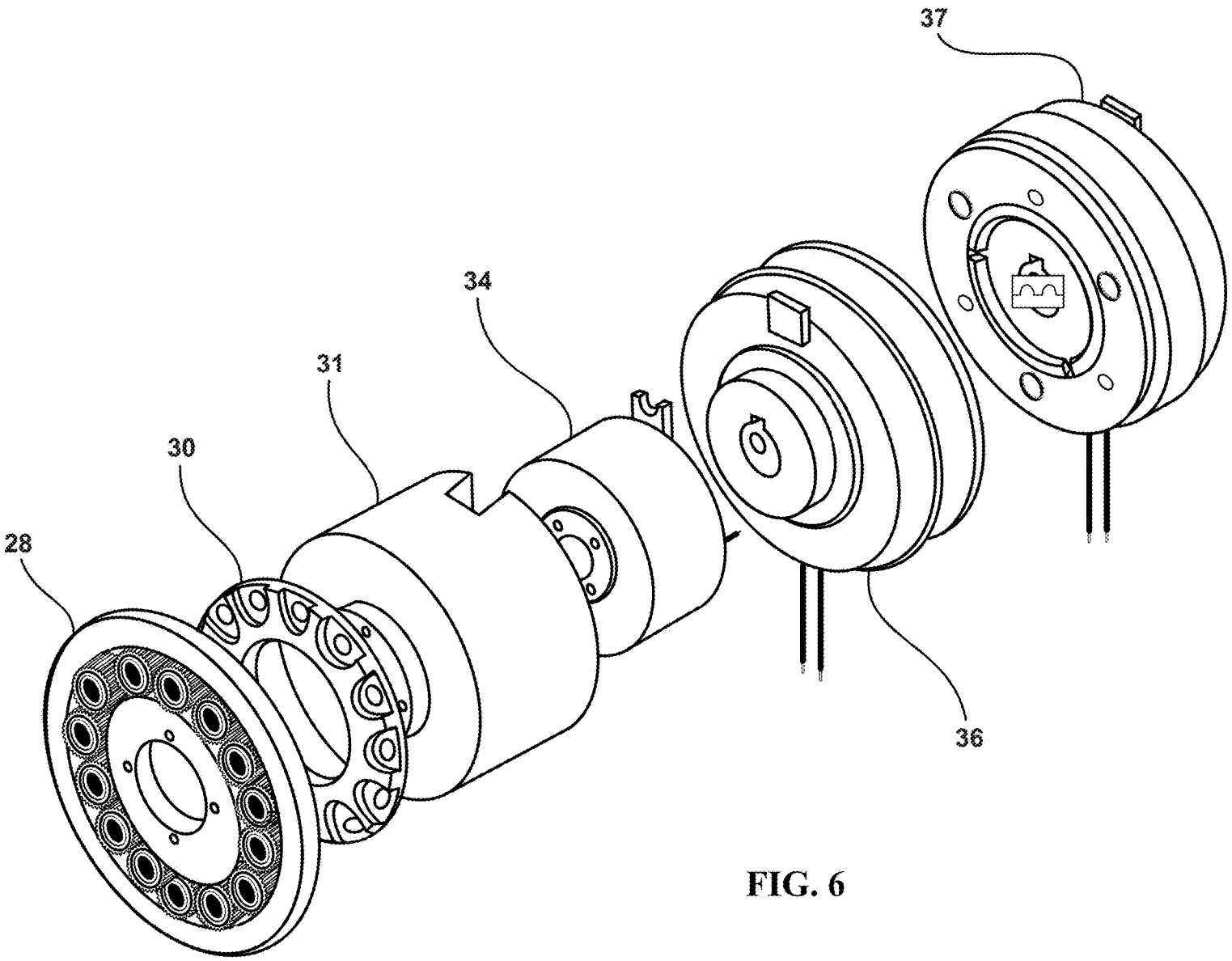
FIG. 6 presents an exploded view of the clutch mechanism without the rotating clutch housing.

FIGS. 5-6 present exploded views of the sub-components of each clutch 20, 22, as the sub-components are arranged internally. The components include an outer stationary clutch housing 26, a planetary gear set 28, back pinion plate 30, a reverse connection plate 32, a slip ring 34, friction clutches 36, internal planetary gear 38, rotating clutch housing 40, stationary strain wave gear plate 42, and strain wave gear assembly 44. The planetary gear set 28 comprises the internal planetary gear 38, the planet gears, and the sun gear.

Component 26 is the outer clutch housing, which includes the front pinion plate (not shown) for the planetary gear set 28. The housing 26 is stationary in that it is fixed to its respective body 12 or nosecone 14, i.e. clutch mechanism 20 to the nosecone 14 and clutch mechanism 22 to the missile body 12, and will not rotate with its respective angled section 16, 18. The 12 countersunk holes 27 on the end of the outer housing 26 allow through-bolts to retain the twelve (in this example) smaller planet gears of the planetary gear set 28. This ensures that the planetary gear set 28 allows reverse direction capability. Six of the 12 holes also connect the motor 24 and a mounting plate 19 (see FIG. 2) to the missile body or the nosecone 14. Six of the twelve countersunk holes on the visible circular face of 26 may be used to prevent the back pinion plate 30 and planet gears 28 from rotating. The other six holes may use longer bolts to perform the same task, but additionally may connect to the body 12 or nosecone 14 via the mounting plate 19. Respective mounting plates 19 will be part of the missile body 12 and nosecone 14. The four holes 21 (see FIG. 2) immediately surrounding the driveshaft through-hole 47 connect the stator of the slip ring 34. This allows power transmission through the slip rings 34 and to the clutches 36, without subjecting the frictional torque of the slip rings 34 on the wires and electrical connections. The wires are routed along the driveshaft 46, in parallel with the screws that connect to the stator of the slip ring 34.

The four holes 29 (see FIG. 4) on the lip of the stationary clutch housing 26 connect to the stationary strain wave gear plate 42. The strain wave gear assembly 44 is described below.

The planetary gear set 28 is the mechanism by which the direction of rotation of the angled sections 16, 18 is reversed. The 12 bolts mentioned above retain the smaller gears (planet gears). Therefore, as the spur gear, i.e. sun gear, in the middle (not shown) rotates, the internal planetary gears 38 will rotate in the opposite direction. It was discovered during testing that the sun gear tended to walk out of plane with the planet gears 38. The back pinion plate 30 and front pinion plate (not shown) keep the sun gear in plane with the planet gears 38. The back pinion plate 30 and front pinion plate hold the planetary gear set 28 together, allowing it to function properly. The back pinion plate 30 includes countersunk holes on the backside to allow it to sit flush with the reverse connection plate 32.

The reverse connection plate 32 serves to transmit torque from the "reverse" friction clutch to the sun gear of the planetary gear set 28. The "reverse" friction clutch 36 is the bottom clutch in FIG. 5, which transmits torque to the planetary gears. The "forward" friction clutch 37 is the top clutch in FIG. 5, and that transmits power directly to the rotating clutch housing 40. The wires 39 of the clutches 36, 37 remain inside the outer housing 26, and connect to the slip ring 34. The cutout 43 on the housing 40 is to allow enough room for the wires to turn 90 degrees to run toward the slip ring 34, and it allows the slip ring to be inside the rotating clutch housing 40. The wires clutch 39 will follow the path of a loop to be routed back inside the rotating clutch housing 40, allowing an electrical connection to the slip ring 34. This cutout 43 allows the slip ring 34 to sit inside of the rotating clutch housing 40. The reverse connection plate 32 receives the torque from the reverse friction clutch 36 via the torque tab 41 and transmits it to the sun gear via the four bolts on the left end of the component as shown in FIG. 5 above. The torque tab 41 is a feature of the electromechanical clutches 36, 37 to permit the torque to be transferred via the driveshaft 46 to the next component. It is shown as the square in FIGS. 5-6 on the edge of clutch 36. The four connecting bolts are parallel to the driveshaft and run inside the circular cutout on the stationary plate 30. Only three of the holes on the sun gear (center part of 28) are visible in FIG. 3, while only two of the holes are visible on the reverse connection plate 32.

The next component is the slip ring 34. The purpose of the slip ring 34 is to transmit electrical power from the stationary power source (not shown) in the missile body 12 to the friction clutches 20, 22. The slip ring 34 has three wires (not shown), which are used for a common ground, and a power wire for each friction clutch.

Friction clutches 36, 37 (both forward and reverse) are fixed to the rotating clutch housing 40. When activated, the clutches 36, 37 engage with the central driveshaft 46, causing them to rotationally accelerate to the angular velocity of the driveshaft, thereby rotating the rotating clutch housing 40, functionally transmitting torque from the driveshaft 46 to the rotating clutch housing 40, and ultimately to the corresponding angled rotating section 16, 18.

Figure 7:
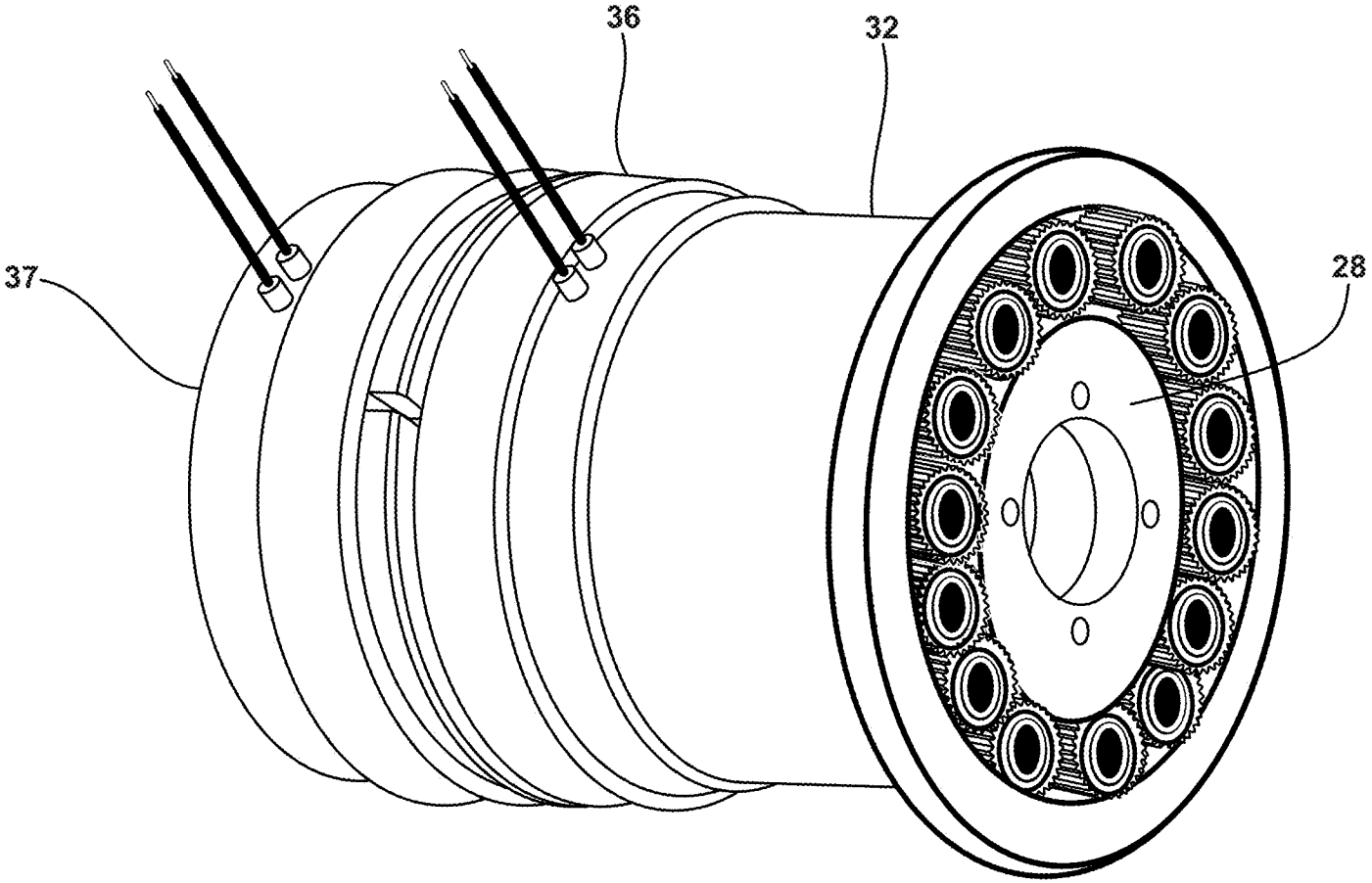
FIG. 7 presents the clutch mechanism of FIG. 6 in assembled form.

The rotating clutch housing 40 (see FIG. 6) serves not only to house all the previously mentioned components, i.e. planetary gear set 28, back pinion plate 30, reverse connection plate 32, slip ring 34, reverse friction clutch 36, forward friction clutch 37, internal planetary gear 38, and clutch wires 39, and also rotates with the driveshaft 46 when the friction clutches 36, 37 are engaged. The attachment point, i.e. holes 49, between the rotating clutch housing 40 and the wave generator component 48 of the strain wave gear 44 is shown in FIG. 6. FIG. 7 illustrates the assembled components of FIG. 6.

Figure 8:
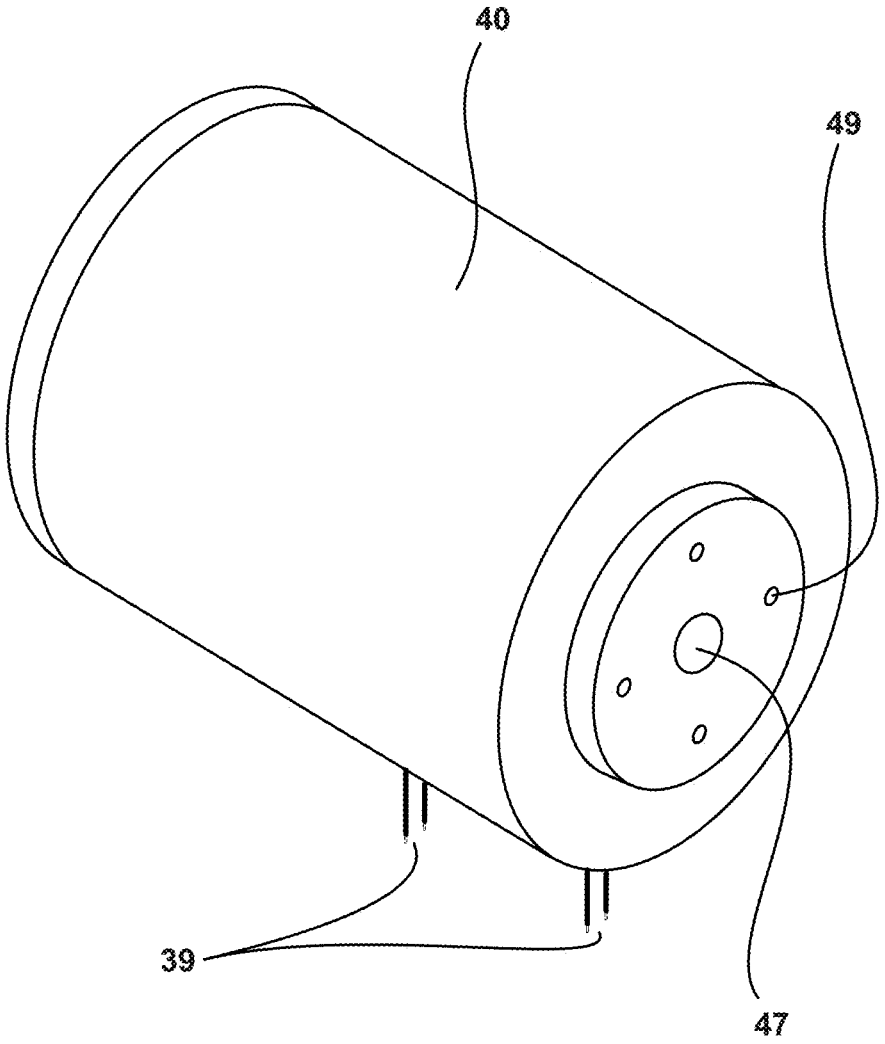
FIG. 8 depicts a rotating clutch housing for an HSVALT device, with a strain wave gear interface visible.
Figure 9A:
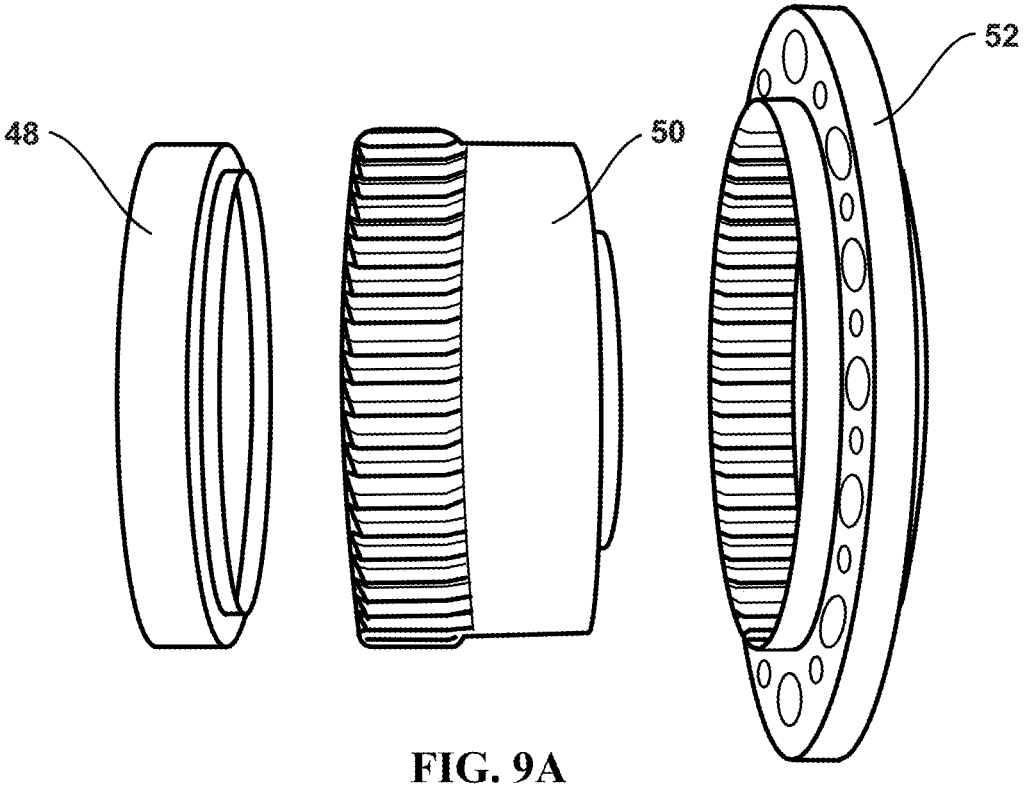
FIGS. 9A-9B depict elements of the strain wave gear assembly.
Figure 9B:
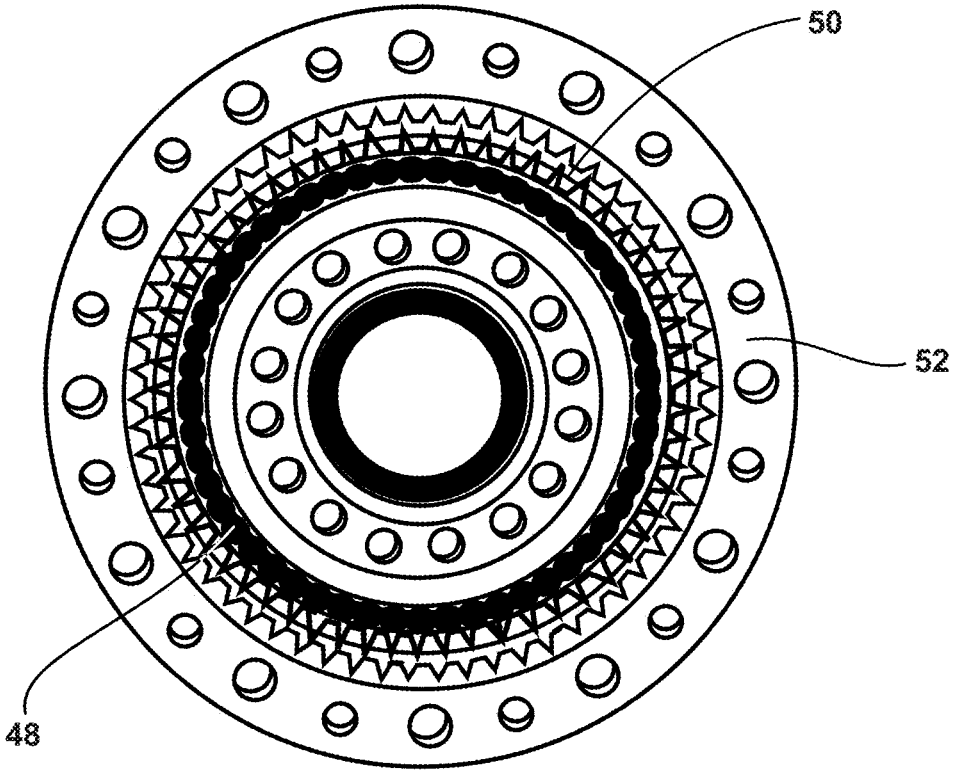

The strain wave gear assembly 44 attaches to the four holes shown in the end of the rotating clutch housing shown in FIG. 8. The center hole is the through-hole 47 for the driveshaft 46, with the four holes 49 connecting the rotating clutch housing 40 to the wave generator piece 48 of the strain wave gear assembly 44. This end of the rotating clutch housing 40 is not seen in FIG. 5 due to the angle of FIG. 5. The strain wave gear assembly 44 is made up of three parts: wave generator 48, flexspline 50, and outer gear 52. These parts are depicted in FIGS. 9A-9B.

The strain wave gear 44 takes a high speed, low torque input through the wave generator 48 and produces a low speed, high torque output through the flexspline 50. The wave generator 48 is connected to the rotating clutch housing 40. The stationary outer gear 52 is connected to the stationary strain wave gear plate 42. The flexspline 50 is connected to its respective rotating section, i.e. the angled rotor 16, 18 via the sixteen bolt holes illustrated on the innermost component of FIG. 9B. When commanded, the friction clutches 36, 37 engage the rotating driveshaft 46, rotating the rotating clutch housing 40, which rotates the wave generator 48. The flexspline 50 then rotates (at lower speed/higher torque), to rotate the particular angled section 16, 18 to which it is attached.

Figure 10:
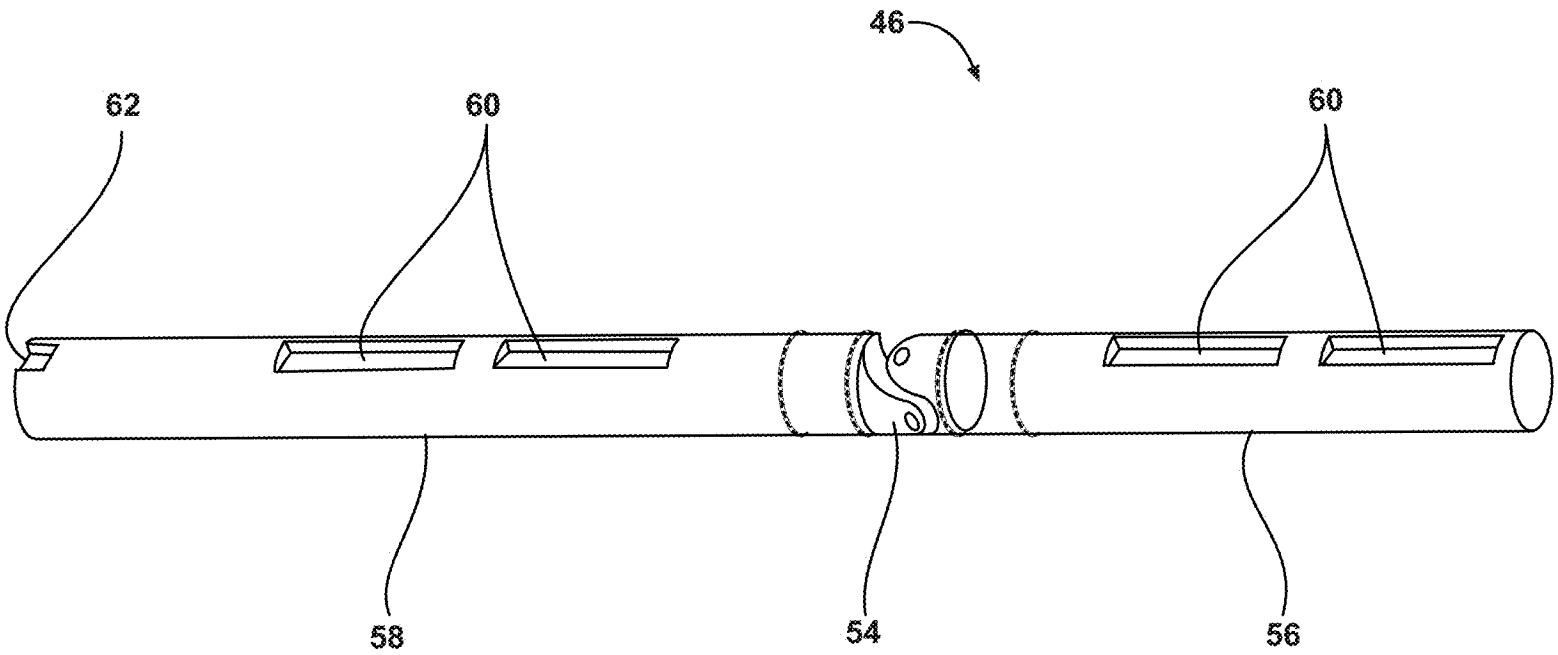
FIG. 10 depicts a driveshaft with keyways and universal joint for an HSVALT device.

Passing through the center of all the components depicted in FIGS. 2-9B is a driveshaft 46 and universal joint assembly 54, shown in FIG. 10. The universal joint 54 communicates torque between the forward shaft 56 and the aft shaft 58 so that torque may be received in the forward angled section 16, regardless of the orientations of the sections 16, 18.

The driveshaft 46 may include four keyways 60 along the middle of the driveshaft to attach the friction clutches 36 to the forward and aft shafts 56, 58. In one embodiment, the keyways 60 are about 5 mm×5 mm keyways, each 1.5 in long. A motor keyway 62 at one end of the aft shaft 58 is used to transmit torque from the motor 24 to the driveshaft 46. The motor keyway 62 may be a 4 mm×4 mm keyway with a length of 0.25 in.

A control mechanism drives the speed of the motor 24 and the operation of the friction clutches 36, 37. For example, in order to perform a desired flight maneuver, if the upper angled section 16 needs to rotate clockwise and the aft angled section 18 counter-clockwise, the motor 24 may be turned in either the clockwise or counter-clockwise direction. Depending on the rotational direction of the motor, power is supplied to either the forward 20 or reverse 22 friction clutches, producing the desired rotational motion (the forward clutch will engage the rotating clutch housing 40 directly, while the reverse clutch 36 will engage the planetary gear set 28, which then engages the rotating clutch housing 40, but in the reverse direction). The mechanism controls the speed of the motor and actuation of the clutches 36, 37 in order to drive the nosecone angle. This control algorithm may receive feedback from the mechanism as to the current rotation angle of each section relative to a pre-determined origin. In addition, the algorithm must actuate the correct clutch when the nosecone reaches the maximum deflection angle.

An embodiment of the invention may be integrated into a missile with a 7-inch outer diameter and 10-foot length, for example. However, the invention is broadly applicable to numerous missile types including other air-to-air missiles, surface-to-air missiles, and even ICBMs. Alternate embodiments may be adapted to cruise missiles in order to improve their efficiency during flight. The embodiment discussed above is focused on missile nosecone actuation. Other methods of torque transmission may be viable at lower torque values, but the angled rotor design above is especially suited for the torque requirements and volume limitations for a missile in flight.

The rotating sections 16, 18 may be manufactured from high strength aluminum, with a minimum thickness as required to withstand the anticipated loads in flight. The stationary clutch housing 26, the back-pinion plate 30, the reverse connection plate 32, rotating clutch housing 40, and stationary strain wave gear plate 42 may all be machined from stock aluminum. The drive shaft 46 is preferably chrome-moly steel. Many of the machined components may be additively manufactured.

Figure 11:
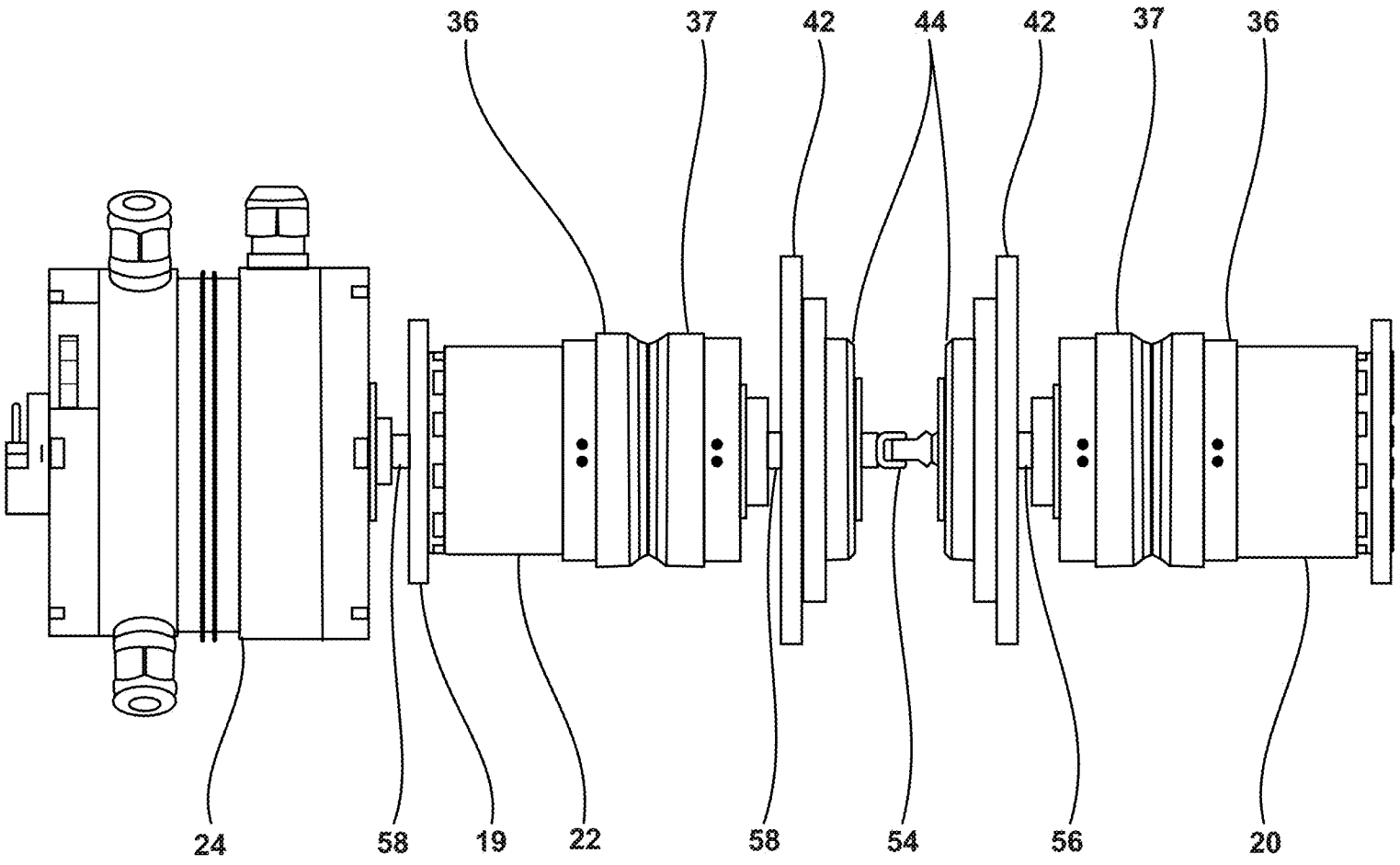
FIG. 11 depicts HSVALT components mounted sequentially on a driveshaft.
Figure 12:
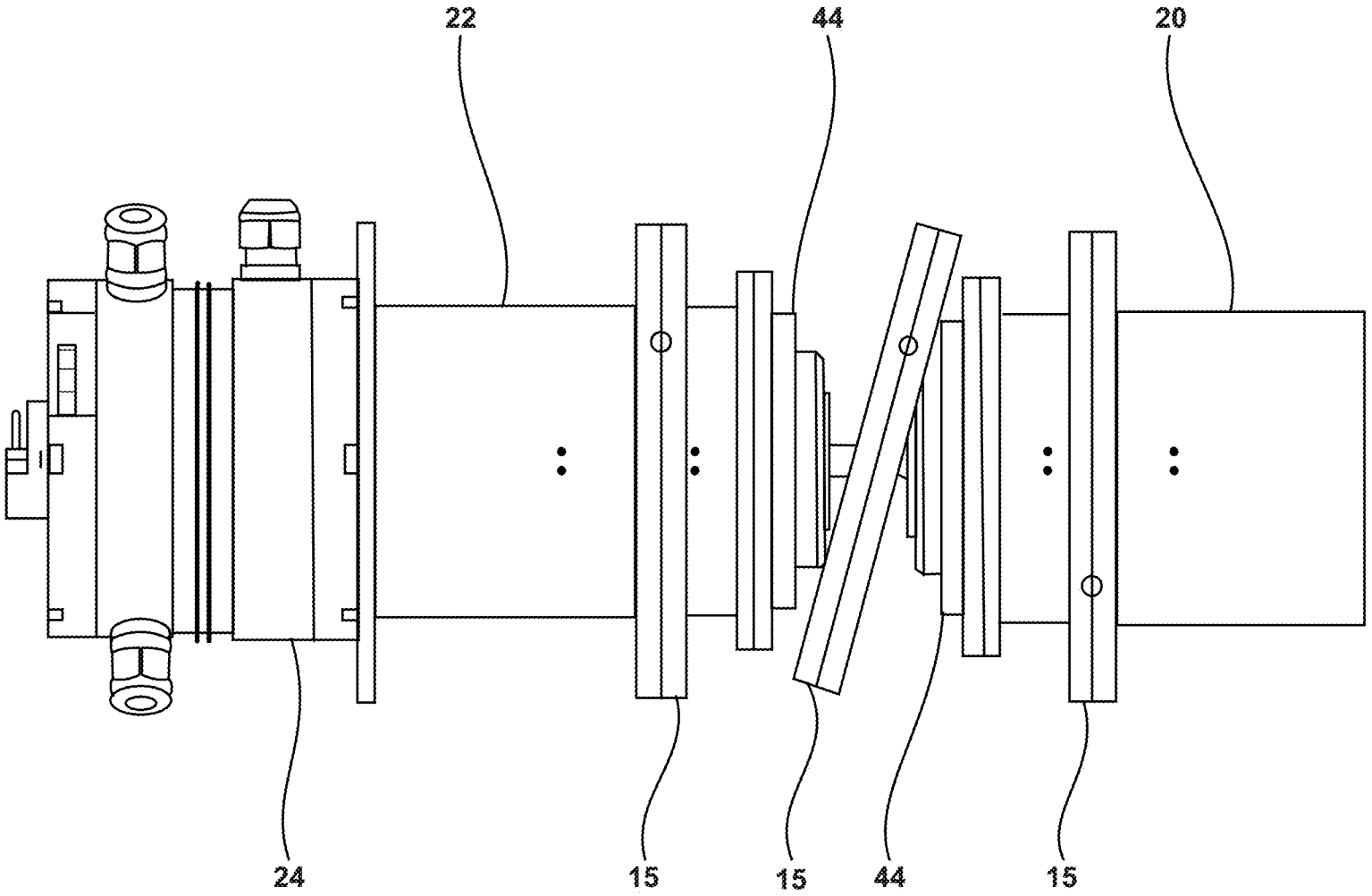
FIG. 12 depicts HSVALT clutch assemblies and motor on a driveshaft.
Figure 13:
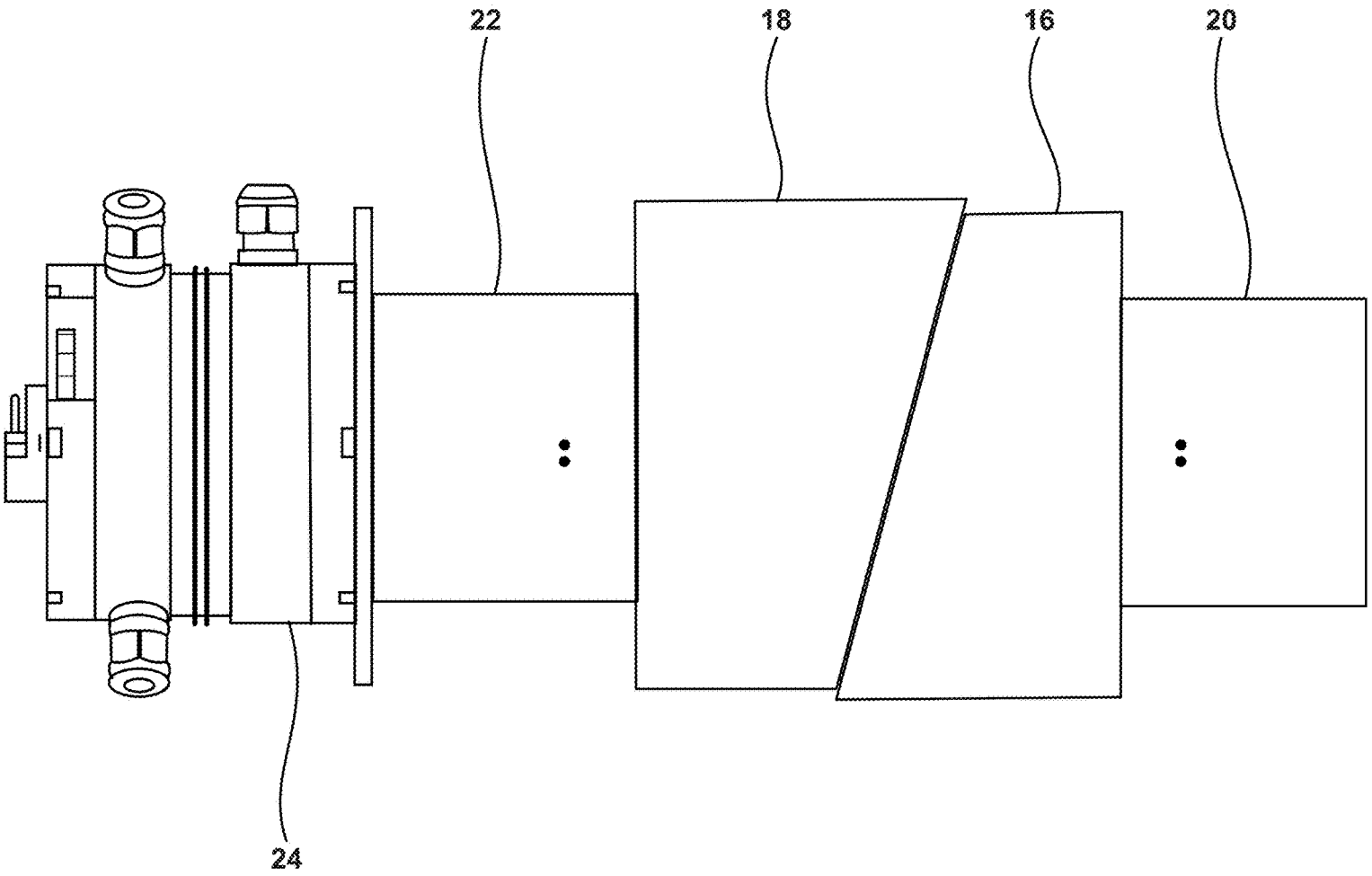
FIG. 13 depicts forward and aft angled sections of the HSVALT mounted on the clutch assemblies.

FIG. 11 illustrates most of the HSVALT components mounted sequentially on a driveshaft 56, 58, without the outer housings 26 of the clutch assemblies 20, 22. FIG. 12 illustrates the outer housing 26 of the clutch assemblies 20, 22 in place around the clutch assemblies 20, 22. FIG. 13 illustrates the angled rotors 16, 18 mounted on the assembly illustrated in FIG. 12.

Figure 14:
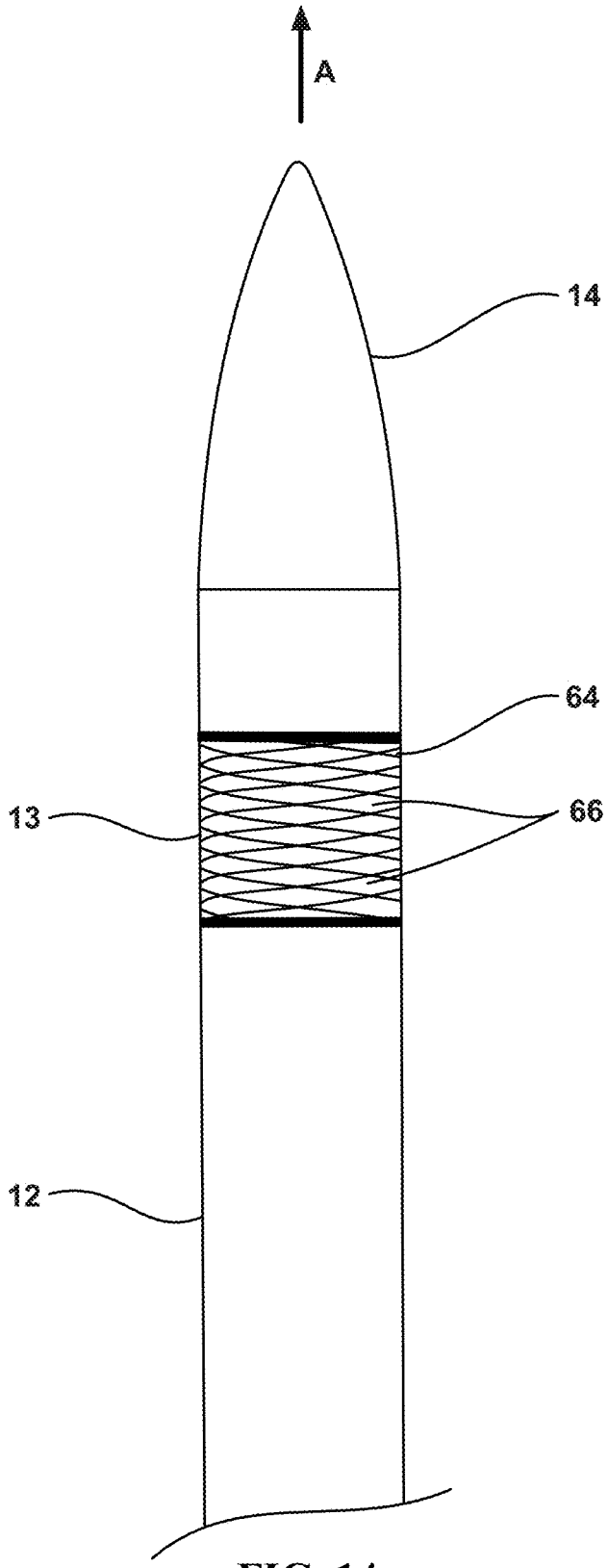
FIG. 14 depicts the HSVALT-equipped missile of FIG. 1 with a flexible skin connecting the nosecone and missile body, the flexible skin over the HSVALT assembly.

FIG. 14 presents an embodiment of the missile 10 additionally including a flexible skin 13 component. The flexible skin 13 may be mounted over the angled rotors 16, 18 to connect the nosecone 14 to the missile body 12 and prevent their relative rotation. Accordingly, as described above, the flexible skin 13 is attached to the nosecone 14 and missile body 12. The relative dimensions of the nosecone 14, missile body 12, flexible skin 13, and angled rotors 16, 18 may be selected so as to provide a smooth, aerodynamic surface.

The HSVALT mechanism as shown here is also broadly scalable to missiles of other dimensions. The outer diameter of the missile and speed at which the missile flies, determine the loads the rotating sections would see during flight and therefore define the minimum required torque that must be generated by the design to rotate the sections 16, 18.

The HSVALT mechanism as presented here is specifically designed to be inserted into a missile body, and provides the capability to deflect the nosecone to a selected angle. The design may easily be scaled and used in a variety of missiles. In addition, there are potential uses for this design wherever torque transfer under load is required. Power take-off devices used on generators and tractors are one example where this device may be used to provide an improvement. In such applications, from a safety standpoint, shrouding the rotating mechanism with a housing prevents safety incidents where the operator's clothes, for example, are caught in the rotating joint. Other potential applications include engines where the torque output from the engine is translated via a shaft to a drivetrain. This device may be inserted between the engine and drivetrain as a way of transferring the torque generated by the engine to the drivetrain.

The following examples illustrate particular properties and advantages of some of the embodiments of the present invention. Furthermore, these are examples of reduction to practice of the present invention and confirmation that the principles described in the present invention are therefore valid but should not be construed as in any way limiting the scope of the invention.

The primary application of the HSVALT is air-to-air missiles. However, surface-to-air missiles could also benefit from this technology. In addition, the design could be used to change the nose angle of hypersonic systems, for instance, in order to improve aerodynamic performance of the system across a range of speeds and altitudes. These systems include intercontinental ballistic missiles, and other ground-to-air or ground-to-ground missile systems. The benefits would be most tangible in systems where last minute extreme corrections are required. However, there are aerodynamic benefits gained from small angle changes during flight that all systems could benefit from.

Any application where torque transfer under load and a change in angle between two connected bodies is required could potentially use this mechanism. Power-take-off devices are commonly included on tractors and generators to provide an additional power source for the end user. These devices are typically a shaft and u-joint providing a connection to the user to attach a shaft to drive some mechanism. This device could replace those if a change in direction of the driven shaft is required. This device could also potentially replace transmissions in small vehicles and provide the capability to both change the angle of the motor relative to the drive shaft and reverse direction.

While the present invention has been illustrated by a description of one or more embodiments thereof and while these embodiments have been described in considerable detail, they are not intended to restrict or in any way limit the scope of the appended claims to such detail. Additional advantages and modifications will readily appear to those skilled in the art. The invention in its broader aspects is therefore not limited to the specific details, representative apparatus and method, and illustrative examples shown and described. Accordingly, departures may be made from such details without departing from the scope of the general inventive concept.

What is claimed is:

1. A missile comprising:

a generally cylindrical body having a distal end and a proximal end, and a longitudinal axis along the length of the generally cylindrical body;

a nosecone having a pointed distal end and a proximal end, wherein the proximal ends of the body and nosecone are oriented toward each other;

a forward angled section rotatably attached to the proximal end of the nosecone at the forward edge of the forward angled section, the opposite end of the forward angled section having an angled edge perpendicular to the longitudinal axis except for the angle defined by the edge;

a rear angled section rotatably attached to the proximal end of the body at the rear edge of the rear angled, the opposite end of the rear angled section having an angled edge matching the angled edge of the forward angled section, the angled edges of the forward angled section and the rear angled section being rotatably attached;

wherein longitudinal rotation of the forward angled section with respect to the rear angled section yields angular displacement of the nosecone with respect to the body.

2. The missile of claim 1, further comprising:

a driveshaft oriented along the longitudinal axis of the body, the rear angled section, the forward angled section, and the nosecone, the driveshaft being releasably fixed to the rear angled section and forward angled section by respective clutches, the driveshaft having a flexible joint where the forward angled section and rear angled section interface;

a motor rotatably fixed to the body and the driveshaft.

3. The missile of claim 1, further comprising:

a flexible skin around the forward angled section and rear angled section, the flexible skin fixed to the nosecone and body.

* * * * *